US011598166B2

(12) United States Patent
Novelen et al.

(10) Patent No.: US 11,598,166 B2
(45) Date of Patent: Mar. 7, 2023

(54) FLOAT EQUIPMENT ASSEMBLIES AND METHODS TO ISOLATE DOWNHOLE STRINGS

(71) Applicant: Halliburton Energy Services, Inc., Houston, TX (US)

(72) Inventors: Ryan Michael Novelen, Grand Prairie, TX (US); Caleb Thomas Warren, Richardson, TX (US); Thomas Owen Roane, Alvord, TX (US); Thomas J Frosell, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 187 days.

(21) Appl. No.: 16/639,293

(22) PCT Filed: Apr. 26, 2019

(86) PCT No.: PCT/US2019/029474
§ 371 (c)(1),
(2) Date: Feb. 14, 2020

(87) PCT Pub. No.: WO2020/219080
PCT Pub. Date: Oct. 29, 2020

(65) Prior Publication Data

US 2021/0131206 A1 May 6, 2021

(51) Int. Cl.

| | |
|---|---|
| ***E21B 21/10*** | (2006.01) |
| ***E21B 33/12*** | (2006.01) |
| ***E21B 34/06*** | (2006.01) |

(52) U.S. Cl.
CPC ..... *E21B 21/10* (2013.01); *E21B 33/12* (2013.01); *E21B 34/06* (2013.01); *E21B 2200/06* (2020.05); *E21B 2200/08* (2020.05)

(58) Field of Classification Search
CPC .. E21B 21/10–106; E21B 21/00; E21B 33/12; E21B 33/00; E21B 34/06;
(Continued)

(56) References Cited

U.S. PATENT DOCUMENTS

| | | | |
|---|---|---|---|
| 7,168,494 | B2 | 1/2007 | Stara et al. |
| 2008/0066931 | A1 | 3/2008 | Xu |

(Continued)

FOREIGN PATENT DOCUMENTS

| | | | |
|---|---|---|---|
| WO | 2008036575 | A1 | 3/2008 |

OTHER PUBLICATIONS

International Search Report and Written Opinion dated Jan. 21, 2020, in related PCT/US2019/029474.

*Primary Examiner* — George S Gray
(74) *Attorney, Agent, or Firm* — Barnes & Thornburg, LLP

(57) ABSTRACT

A float equipment assembly includes an inner string that provides a fluid flow path through the float equipment assembly. The float equipment assembly also includes an opening through which a fluid flowing through the inner string exits the float equipment assembly. The float equipment assembly further includes a moveable member, which when repositioned, isolates the inner string. The float equipment assembly further includes a dissolvable material that initially prevents repositioning of the moveable member, where the moveable member is repositioned after a threshold portion of the dissolvable material has dissolved.

7 Claims, 7 Drawing Sheets

(58) Field of Classification Search
CPC .... E21B 34/063; E21B 34/14; E21B 2200/06; E21B 2200/08
See application file for complete search history.

(56) References Cited

U.S. PATENT DOCUMENTS

| | | | | |
|---|---|---|---|---|
| 2012/0318513 | A1 | 12/2012 | Mazyar et al. | |
| 2015/0337624 | A1* | 11/2015 | Themig | E21B 33/146 166/285 |
| 2016/0251937 | A1* | 9/2016 | Fripp | E21B 34/063 166/373 |
| 2017/0183937 | A1* | 6/2017 | Harper | E21B 34/14 |
| 2018/0051533 | A1 | 2/2018 | Zbranek et al. | |

* cited by examiner

FLOAT EQUIPMENT ASSEMBLIES AND METHODS TO ISOLATE DOWNHOLE STRINGS

BACKGROUND

The present disclosure relates generally to float equipment assemblies and methods to isolate downhole strings.

A Float equipment is sometimes deployed with a completion assembly in a wellbore during well completion. While the completion string is traveling downhole, the float equipment facilitates fluid circulation through an end of a completion string to remove debris and other undesirable materials or to change fluid type in the wellbore while the completion assembly is traveling downhole, which facilitates the completion assembly to reach a desired depth in the wellbore. However, after the completion string has been deployed in a desirable location in the wellbore, the float equipment continues to provide fluid flow paths for fluids to flow from the completion string, out of the float equipment, and into the wellbore. Sometimes, a well intervention operation is performed to isolate downhole strings coupled to the float equipment to prevent fluids from flowing in through or out of the float equipment. However, well intervention operations are costly and time consuming.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1A:
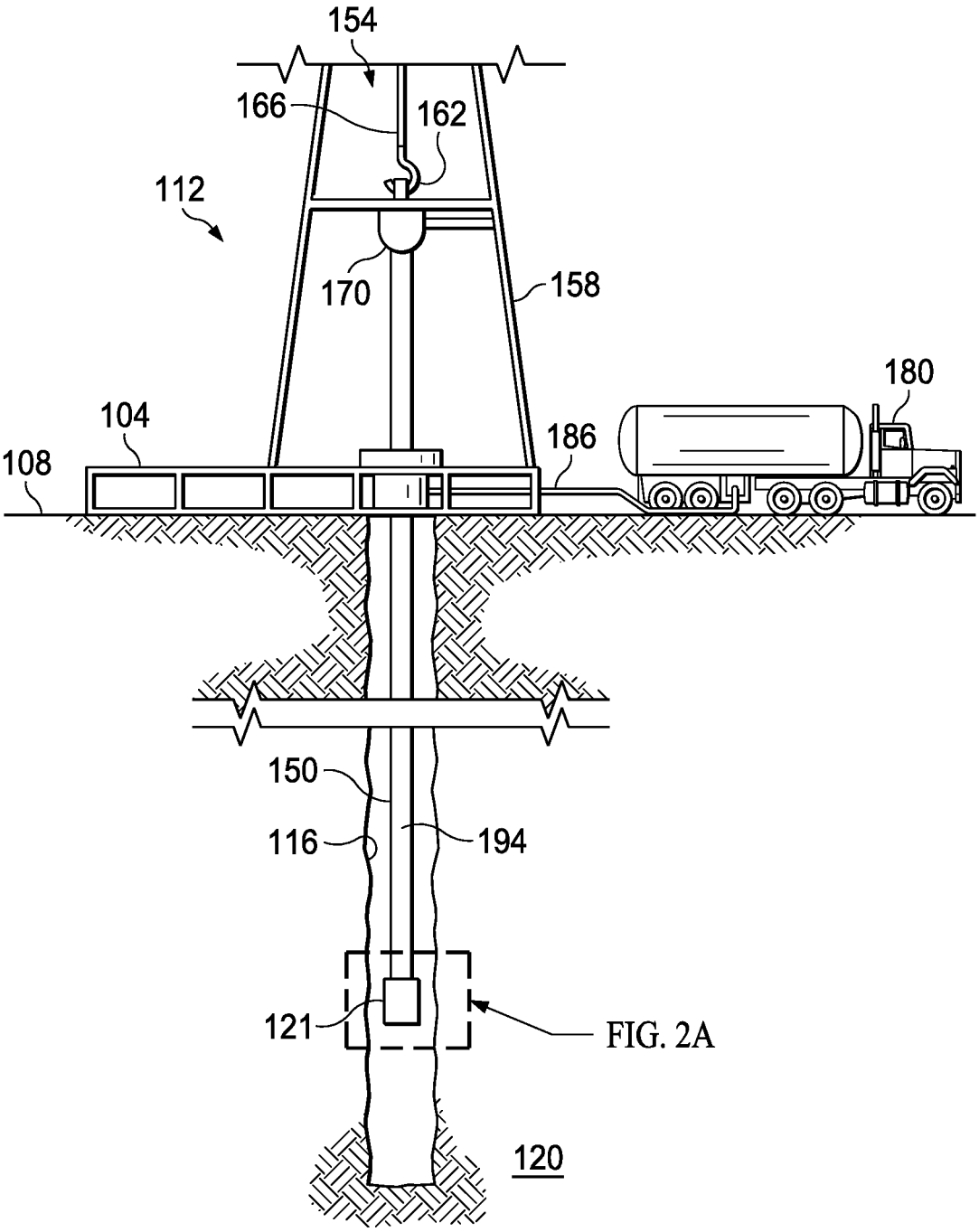
FIG. 1A illustrates a schematic view of an on-shore well having a float equipment assembly of FIG. 2A coupled to a completion string during completion of the well.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to float equipment assemblies and methods to isolate downhole strings. As referred to herein, a float equipment assembly includes various types of float shoes, float shoe assemblies, float collars, and float collar assemblies. The float equipment assembly includes an inner string that provides a fluid flow path through the float equipment assembly. As referred to herein, the inner string of the float equipment assembly is any string or component of the float equipment assembly that provides a fluid flow path through the float equipment assembly. In some embodiments, where the float equipment assembly is coupled to another downhole string (e.g., a completion string, a work string, casing string, liner, or another type of conveyance that is deployed downhole), the inner string of the float equipment assembly is also fluidly coupled to the downhole string to provide a fluid flow path for fluids flowing through the downhole string to exit the float equipment assembly through one or more openings of the float equipment assembly. In some embodiments, the inner string forms a portion of an annulus of the downhole string or is a portion of the downhole string. The float equipment assembly also includes a moveable member, when repositioned, closes the one or more openings of the float equipment assembly, thereby isolating the downhole string. As referred to herein, a moveable member is any device that controls passage of fluids through the float equipment assembly. In some embodiments, the moveable member is a piston assembly that includes one or more pistons which, when repositioned, closes the one or more openings of the float equipment assembly. As referred to herein, a moveable member is repositioned if the moveable member, or a component of the moveable member moves to another location within the float equipment assembly that is different from an initial position of the moveable member before deployment of the float equipment assembly. In some embodiments, the moveable member includes a spring and a sliding sleeve. In one or more of such embodiments, force generated by the spring causes the sliding sleeve to slide over the one or more openings to isolate the downhole string. In some embodiments, the moveable member is a ball or another object that is initially deposited in the inner string. In one or more of such embodiments, the downhole string is isolated after the ball slides over the one or more openings. Example embodiments of different moveable members are illustrated in FIGS. 2A, 2B, 3A, 3B, 4A, 4C, and 5A-5C, and are described in the below paragraphs.

The float equipment assembly also includes a dissolvable material that initially prevents the moveable member from reaching a position that would isolate the flow path when the float equipment assembly is initially deployed downhole. As referred to herein, a dissolvable material is any material that dissolves or degrades when the material comes into contact with another material, such as, but not limited to, brine, wellbore fluids, drilling fluids, hydrocarbon resources, or other types of solids or fluids having properties that dissolves the dissolvable material over time. Examples of different types of dissolvable materials include, but are not limited to dissolvable or degradable metals (such as but not limited to aluminum alloys, magnesium alloys, calcium alloys, and zinc alloys), plastics (such as but not limited to urethane, EPDM, thiol, PGA, PLA, and hydrolytically degradable aliphatic polyester), salt, borate, or polymers that corrode, hydrolyze, or grow into in unconsolidated state. In some embodiments, the dissolvable material reaches a threshold dissolvability where a threshold portion (e.g., 5%, 10%, 25%, or another portion) of the dissolvable material has dissolved between five minutes to five months. In some embodiments, where the dissolvable material is a degradable material, the degradable material degrades to a threshold level (e.g., 75% of initial mechanical strength, 50% of initial mechanical strength, 25% of initial mechanical strength, etc.) between five minutes to five months. In some embodiments, where the moveable member is a piston stored in a chamber of the float equipment assembly, the dissolvable material is a plug that initially seals the chamber. After the float equipment assembly is deployed downhole, pressure outside of the chamber (e.g., pressure due to fluids flowing through the float equipment) becomes greater than pressure inside the chamber. Further, and after a threshold portion of the dissolvable material (e.g., 1%, 5%, 50%, or another portion) has dissolved, the chamber is no longer sealed, and a hydrostatic pressure caused by fluids flowing into the chamber is applied to the piston, thereby repositioning the piston. Additional illustrations of the piston assembly are provided in at least FIGS. 2A and 2B.

In some embodiments, where the moveable member includes a spring and a sliding sleeve, the dissolvable material initially holds the spring in a compressed state. In such embodiments, after a threshold portion of the dissolvable material (e.g., 1%, 5%, 50%, or another portion) has dissolved, a force generated by the spring as the spring reverts to an uncompressed state is applied to the sliding sleeve. As the spring comes in contact with the sliding sleeve, the force generated by the spring causes the sliding sleeve to slide over the one or more openings to isolate the downhole string. Similarly, where the dissolvable material is a degradable material, the degradable material initially holds the spring in a compressed state. However, force generated by the spring eventually causes the sliding sleeve to slide over the openings after the degradable material degrades to the point (e.g., 90% of initial mechanical strength, 50% of initial mechanical strength, etc.) where the degradable material is no longer strong enough to resist force generated by the compressed spring. In one or more of such embodiments, the sliding sleeve includes a locking mechanism that locks the sliding sleeve into position once the sliding sleeve has covered the one or more openings to maintain isolation of the downhole string. In one or more of such embodiments, the locking mechanism includes a protrusion on the sliding sleeve that slides into a groove of the float equipment assembly to prevent subsequent movement of the sliding sleeve. In one or more of such embodiments, the locking mechanism includes one or more collets that prevent subsequent movement of the sliding sleeve. In one or more of such embodiments, a collet is a portion of the sliding sleeve that is used to retain the sliding sleeve in a given position. In such embodiments, one or more detents are used to hold the sliding sleeve in an open state and then in a closed state.

In one or more of such embodiments, collets are designed to allow movement of the detents such that the sleeve can shift from one position to the next. In such embodiments, in order to shift the sleeve to the closed state, one or more detents are compressed entering their final profiles until the detents can relax to their uncompressed states, thereby locking the sliding sleeve.

In some embodiments, where the moveable member is a ball deposited in the inner string and where the one or more openings are along a bottom end of the float equipment assembly, the dissolvable material initially includes one or more fingers that prevent the ball from sliding to the bottom end of the float equipment assembly. As referred to herein, the top end of the float equipment assembly is the end closest to the downhole string, whereas the bottom end of the float equipment assembly is the opposite end of the top end. In one or more of such embodiments, the dissolvable material forms a cage around the ball to prevent the ball from sliding to the bottom end of the float equipment assembly. In one or more of the foregoing embodiments, the dissolvable material has one or more fluid channels that provide fluid flow paths through the dissolvable material while the ball is held by the dissolvable material. In one or more of such embodiments, after a threshold portion of the dissolvable material (e.g., 1%, 5%, 50%, or another portion) has dissolved, force generated by fluids flowing through the float equipment assembly causes the ball to slide to the bottom end of the float equipment assembly and cover the one or more openings. Once the ball has reached the bottom end of the float equipment assembly, the ball rests on a seat and is kept on the seat by force generated by the fluids, preventing further movement of the ball, and thereby isolating the downhole string.

Figure 1B:
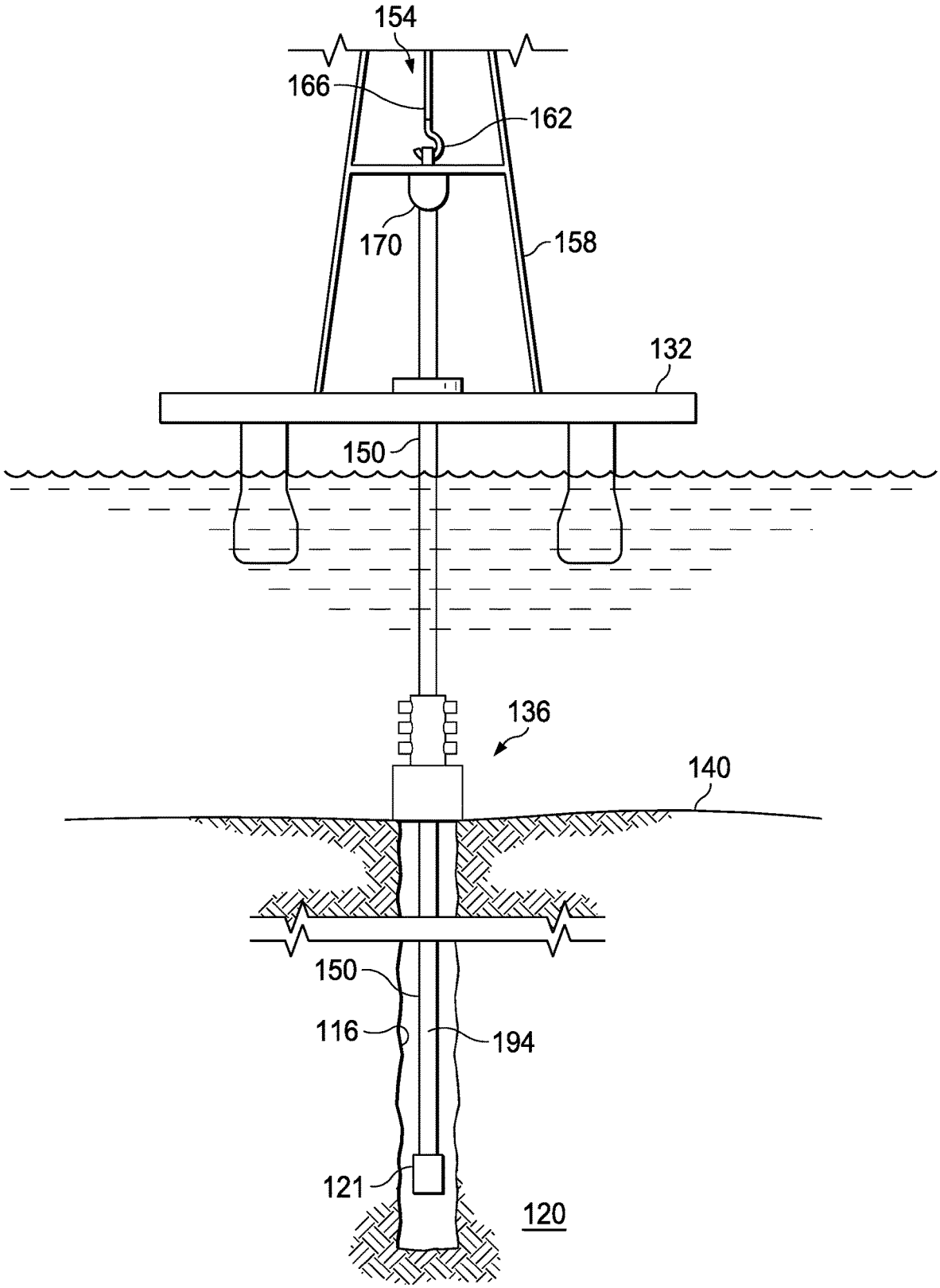
FIG. 1B illustrates a schematic view of an off-shore platform having the float equipment assembly of FIG. 2A coupled to a completion string during completion of the well.

In some embodiments, the float equipment assembly is coupled to a completion string to form a completion assembly that is deployed during completion. FIGS. 1A and 1B illustrate embodiments where a completion assembly is deployed in an on-shore and an off-shore well, respectively. Additional details of the foregoing float equipment assembly, completion assembly, and methods to isolate a downhole string are provided in the paragraphs below and are illustrated in at least FIGS. 1-6.

Now turning to the figures, FIG. 1A illustrates a schematic view of an on-shore well 112 having a float equipment assembly 121 deployed in the well 112. The well 112 includes a wellbore 116 that extends from surface 108 of the well 112 to a subterranean substrate or formation 120. The well 112 and rig 104 are illustrated onshore in FIG. 1A. Alternatively, FIG. 1B illustrates a schematic view of an off-shore platform 132 having a float equipment assembly 121 according to an illustrative embodiment. The float equipment assembly 121 in FIG. 1B may be deployed in a sub-sea well 136 accessed by the offshore platform 132. The offshore platform 132 may be a floating platform or may instead be anchored to a seabed 140.

In the embodiments illustrated in FIGS. 1A and 1B, the wellbore 116 has been formed by a drilling process in which dirt, rock and other subterranean material is removed to create the wellbore 116. During or after the drilling process, a portion of the wellbore 116 may be cased with a casing (not illustrated). In other embodiments, the wellbore 116 may be maintained in an open-hole configuration without casing. The embodiments described herein are applicable to either cased or open-hole configurations of the wellbore 116, or a combination of cased and open-hole configurations in a particular wellbore.

After the drilling of the wellbore 116 is complete and the associated drill bit and drill string are "tripped" from the wellbore 116, a completion string 150 string is lowered into the wellbore 116. In some embodiments, the completion string 150 includes an annulus 194 disposed longitudinally in the completion string 150 that allows fluid flowing from a fluid source 180 (vehicle) on the surface 108 of the well 112 downhole.

The lowering of the completion string 150 may be accomplished by a lift assembly 154 associated with a derrick 158 positioned on or adjacent to the rig 104 or offshore platform 132. The lift assembly 154 may include a hook 162, a cable 166, a traveling block (not shown), and a hoist (not shown) that cooperatively work together to lift or lower a swivel 170 that is coupled to an upper end of the completion string 150. Additional sections of the completion string 150 may be added until the completion string 150 is lowered to a desired depth.

Figure 2B:
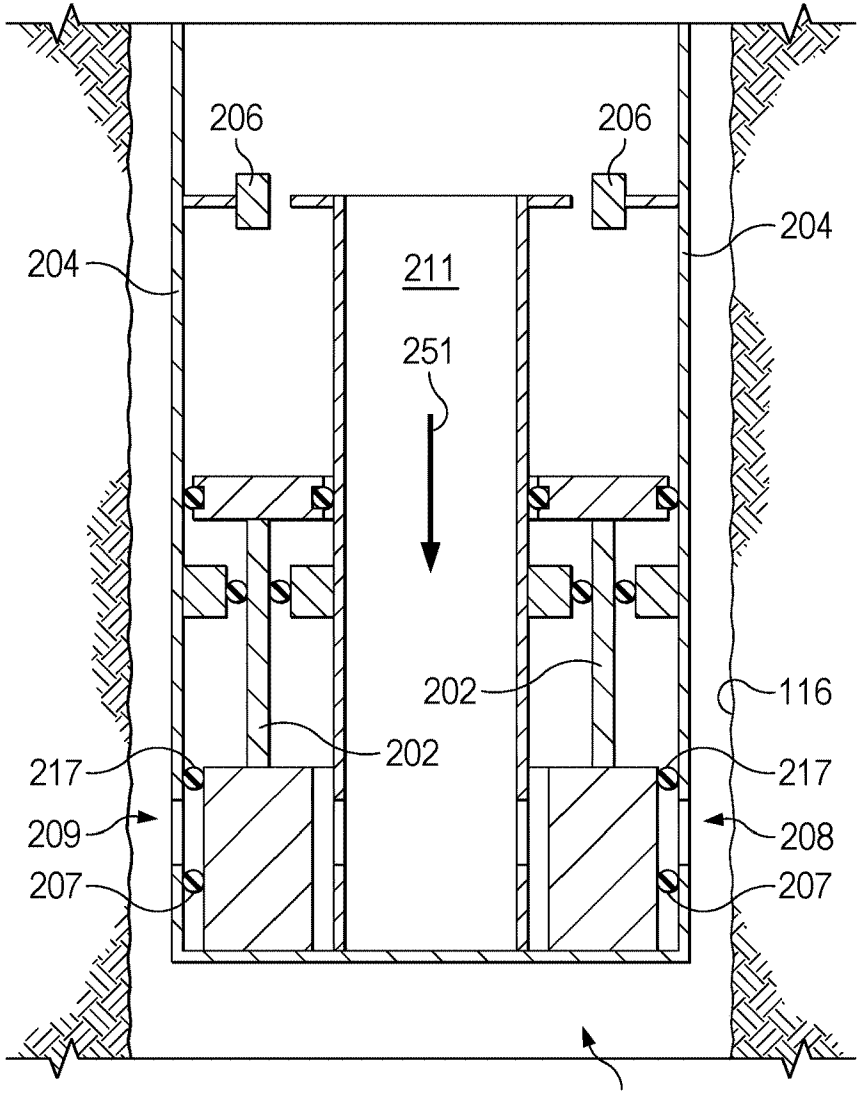
FIG. 2B illustrates a detailed cross-sectional view of the float equipment assembly of FIG. 2A after the threshold portion of the dissolvable material has dissolved.
Figure 3B:
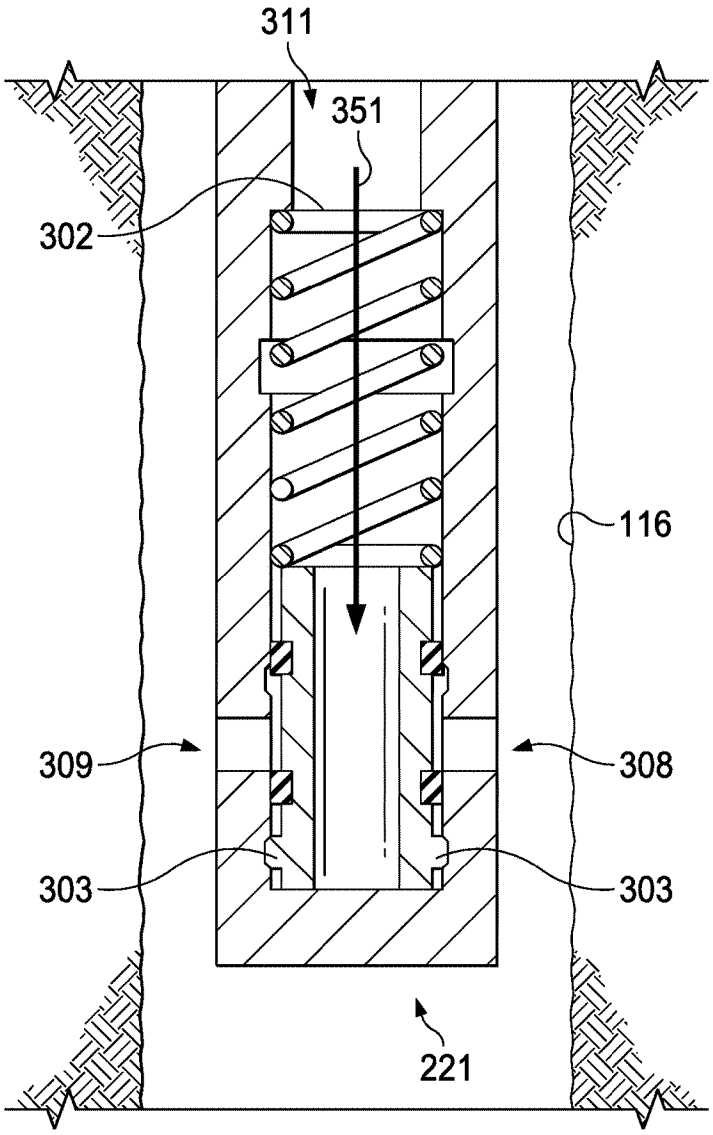
FIG. 3B illustrates a detailed cross-sectional view of the float equipment assembly of FIG. 3A after the threshold portion of the dissolvable material has dissolved.
Figure 3A:
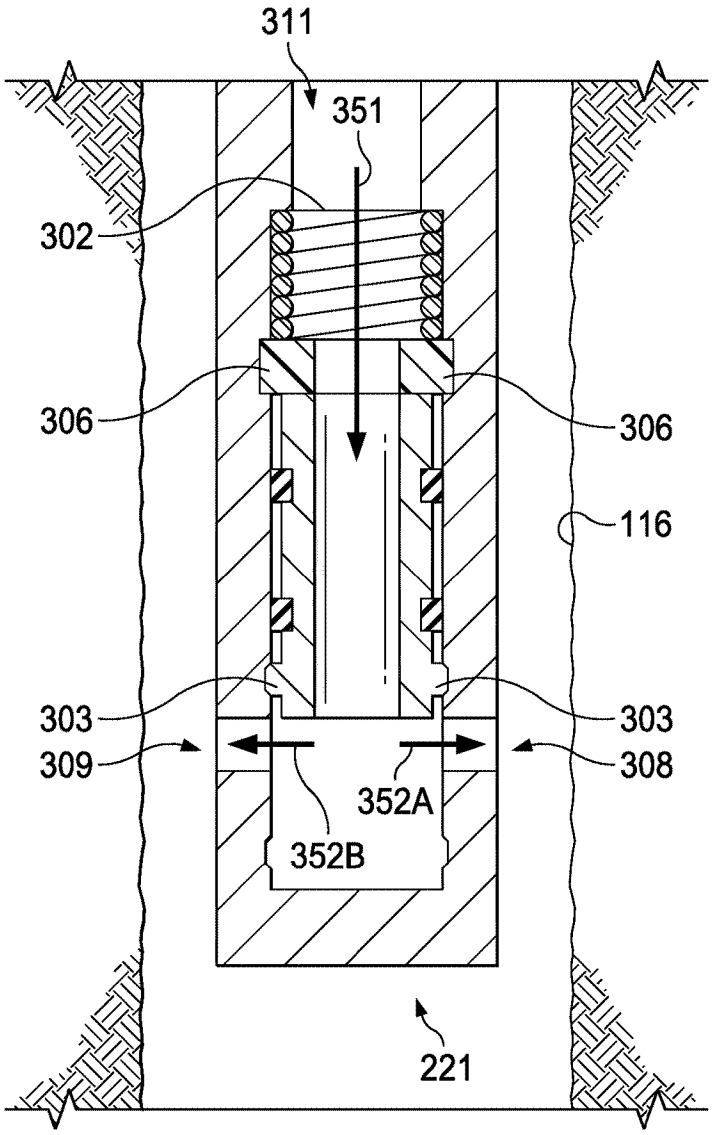
FIG. 3A illustrates a detailed cross-sectional view of a float equipment assembly in accordance to another embodiment before a threshold portion of a dissolvable material has dissolved.
Figure 4C:
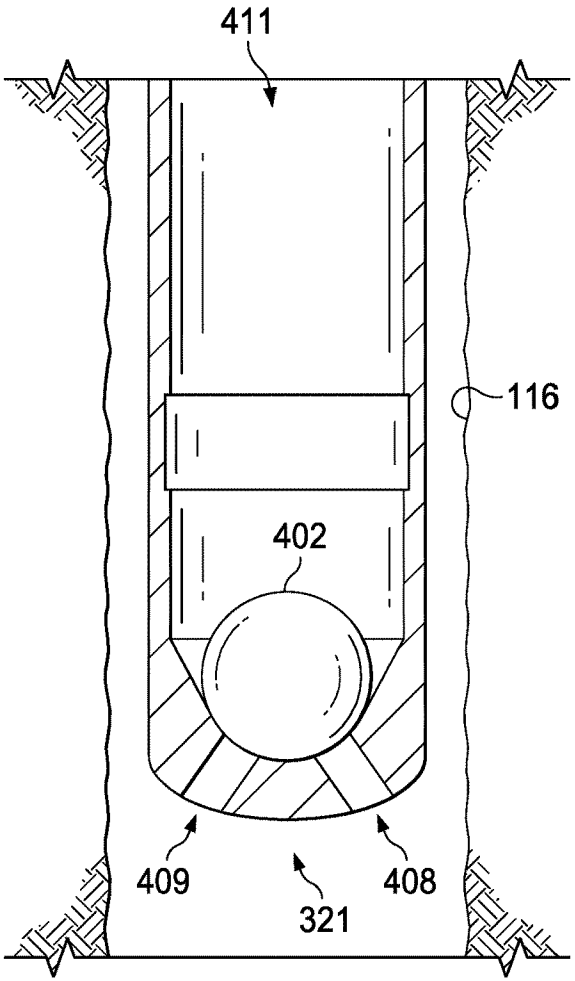
FIG. 4C illustrates a detailed cross-sectional view of the float equipment assembly of FIG. 4A after the threshold portion of the dissolvable material has dissolved.

In the illustrated embodiment of FIG. 1A, a surface-based fluid flows from a fluid source 180 via an inlet conduit 186 that connects the fluid source 180 to the completion string 150, into the annulus 194. The completion string 150 is fluidly coupled to the float equipment assembly 121 which, during wellbore completion, provides a fluid flow path for fluids flowing through the annulus 194 to exit the float equipment assembly 121 into the wellbore 116. Although the completion string 150 of FIGS. 1A and 1B is coupled to the float equipment assembly 121 of FIGS. 2A and 2B, in some embodiments, the completion string 150 is coupled to a float equipment assembly 221 as illustrated in FIGS. 3A and 3B, a float equipment assembly 321 as illustrated in FIGS. 4A and 4C, a float equipment assembly 421 as illustrated in FIGS. 5A-5C, or another float equipment assembly described herein.

As described herein, the float equipment assembly 121 initially provides a fluid flow path for fluids flowing downhole through the annulus 194 to exit the float equipment assembly 121 through one or more openings of the float equipment assembly 121. After completion of the well, one or more moveable members of the float equipment assembly 121 are repositioned to cover the openings of the float equipment assembly 121, thereby fluidly isolating the annulus 194 of the completion string 150 from the wellbore 116. In some embodiments, moveable members of the float equipment assembly 121 illustrated in FIGS. 2A and 2B, or other embodiments of the float equipment assembly described herein, are repositioned once the completion string 150 is set at a desired location in the wellbore 116 to fluidly isolate the annulus 194 of the completion string 150 from the wellbore 116. In some embodiments, moveable members of the float equipment assembly 121 illustrated in FIGS. 2A and 2B, or other embodiments of the float equipment assembly described herein, are repositioned prior to, during, or after completion of another process to fluidly isolate the annulus 194 of the completion string 150 from the wellbore 116. Additional descriptions and illustrations of the float equipment assembly 121 and similar float equipment assemblies 221, 321, and 421 are provided in the paragraphs below and are illustrated in at least FIGS. 3A, 3B, 4A, 4C, and 5A-5C.

Although FIGS. 1A and 1B illustrate completion environments, the float equipment assembly 121 may also be deployed in various production environments or drilling environments where fluid may be guided to the float equipment assembly 121. Further, although FIGS. 1A and 1B illustrate a single float equipment assembly 121, multiple float equipment assemblies may be deployed in the well 112. In another one of such embodiments, the wellbore 116 is a multilateral wellbore. In such embodiment, one or more float equipment assemblies 121 described herein may be deployed in each lateral wellbore of the multilateral wellbore to isolate respective downhole strings deployed in each lateral wellbore.

Figure 2A:
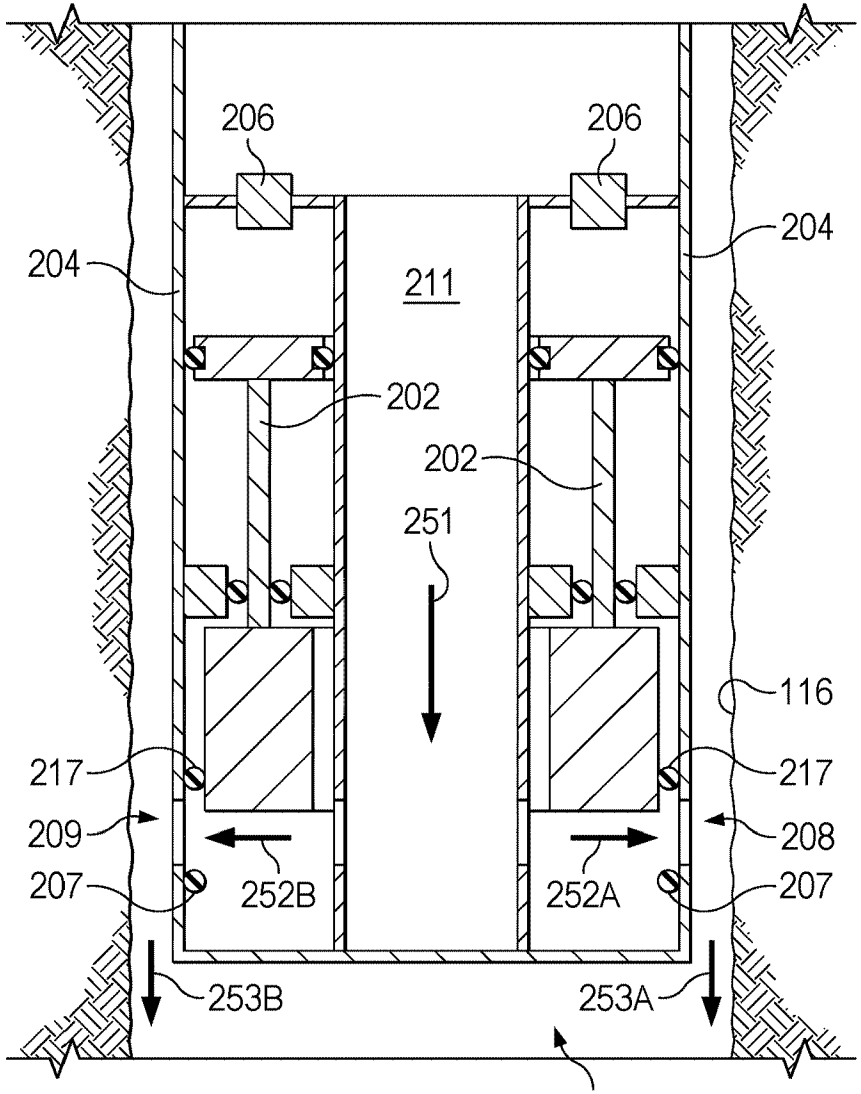
FIG. 2A illustrates a detailed cross-sectional view of the float equipment assembly of FIGS. 1A and 1B before a threshold portion of a dissolvable material has dissolved.

FIG. 2A illustrates a detailed cross-sectional view of the float equipment assembly 121 of FIGS. 1A and 1B before a threshold portion of a dissolvable material 206 has dissolved. In the illustrated embodiment, the float equipment assembly 121 contains a piston 202 initially sealed within a chamber 204. In the illustrated embodiment, the dissolvable material 206 is a dissolvable plug that initially seals the interior of the chamber 204 from fluids flowing through the float equipment assembly 121. In the illustrated embodiment, the float equipment assembly 121 contains an inner string 211 that is fluidly coupled to a downhole string, such as to the annulus 194 of the completion string 150 of FIGS. 1A and 1B. In some embodiments, the inner string 211 is an extension of a downhole string, such as the completion string 150 of FIGS. 1A and 1B. Further, fluids flowing through the inner string 211 of the float equipment assembly 121 initially flow along a flow path illustrated by arrows 251 and 252A and exit the float equipment assembly 121 via opening 208 of the float equipment assembly 121, or along a second flow path illustrated by arrows 251 and 252B and exit the float equipment assembly 121 via opening 209 of the float equipment assembly 121. The fluids then flow into the wellbore 116 in directions illustrated by arrows 253A or 253B, or in other directions (not shown). Further, two sealing surfaces 207 and 217 are positioned on each side of the openings 208 and 209. Examples of sealing surfaces include, but are not limited to seal rings, elastomers, and metal-to-metal seals. While the chamber 204 is sealed, the amount of pressure exerted on the piston 202 is insufficient to reposition the piston 202. After the completion of the well, the dissolvable material 206 is partially or completely dissolved to reposition the piston 202 and to close the openings 208 and 209.

FIG. 2B illustrates a detailed cross-sectional view of the float equipment assembly 121 of FIG. 2A after the threshold portion of the dissolvable material 206 has dissolved. In some embodiments, fluids flowing through a downhole string, such as to the annulus 194 of the completion string 150 of FIGS. 1A and 1B, dissolve the dissolvable material 206 after the fluids come in contact with the dissolvable material 206. In some embodiments, the dissolvable material 206 dissolves over time and is partially or completely dissolved after the wellbore completion process. In some embodiments, a fluid or substance containing properties that dissolve the dissolvable material comes into contact with the dissolvable material 206 after the wellbore completion process. After the dissolvable material 206 has partially or completely dissolved, a hydrostatic pressure exerted on the piston 202 moves/repositions the piston 202 within the chamber 204, and causes the piston 202 to slide across sealing surfaces 207 and 217, thereby preventing fluids to flow through the openings 208 and 209, and isolating the inner string 211 from the wellbore 116. Although FIGS. 2A and 2B illustrate a cross-sectional view of one piston 202, in some embodiments, the float equipment assembly 121 includes two or more pistons (not shown) that are separately or collectively repositioned to isolate the inner string 211 from the wellbore 116. Further, in the embodiment of FIG. 2B, the piston 202 is repositioned by hydrostatic pressure after approximately 50% of the dissolvable material has dissolved. In some embodiments, the piston 202 is repositioned after a different threshold portion (e.g., 10%, 30%, 100%, or another percent) of the dissolvable material has dissolved. Further, although FIGS. 2A and 2B illustrate two openings 208 and 209, the float equipment assembly 121 may include a different number of openings (not shown).

FIG. 3A illustrates a detailed cross-sectional view of a float equipment assembly 221 in accordance to another embodiment before a threshold portion of a dissolvable material 306 has dissolved. In the illustrated embodiment, the float equipment assembly 221 contains a spring 302 and a sliding sleeve 303. The spring 302 is initially held in a compressed state by the dissolvable material 306. In some embodiments, the spring 302 is a mechanical spring. In one or more of such embodiments, the mechanical spring is a helical spring, a wave spring, a belville spring, or a torsion spring. In some embodiments, the spring 302 is a compressed fluid, such as nitrogen. In the illustrated embodiment, the float equipment assembly 221 contains an inner string 311 that is fluidly coupled to the annulus 194 of the completion string 150 of FIGS. 1A and 1B. Further, fluids flowing through the inner string 311 of the float equipment assembly 221 initially flow along a flow path illustrated by arrows 351 and 352A and exit the float equipment assembly 221 via opening 308 of the float equipment assembly 221, or along a second flow path illustrated by arrows 351 and 352B and exit the float equipment assembly 221 via opening 309 of the float equipment assembly 221. During completion of the well, the dissolvable material 306 prevents the spring 302 from reverting into an uncompressed state. However, after the dissolvable material 306 has partially or completely dissolved, the spring 302 reverts to its uncompressed state, and force generated by the spring 302 repositions the sliding sleeve 303 to close the openings 308 and 309.

FIG. 3B illustrates a detailed cross-sectional view of the float equipment assembly 221 of FIG. 3A after the threshold portion of the dissolvable material 306 of FIG. 3A has dissolved. In some embodiments, fluids flowing through the inner string 311 dissolve the dissolvable material 306 after the fluids come in contact with the dissolvable material 306. In some embodiments, the dissolvable material 306 dissolves over time and is partially or completely dissolved after the wellbore completion process. In some embodiments, a fluid or substance containing properties that dissolve the dissolvable material 306 comes into contact with the dissolvable material 306 after the wellbore completion process. After the dissolvable material 306 has partially or completely dissolved, force generated by the spring 302 reverting to its uncompressed state is applied to the sliding sleeve 303, causing the sliding sleeve 304 to slide over the openings 308 and 309, thereby fluidly isolating the inner string 311 from the wellbore 116. In some embodiments, the float equipment assembly 221 has a locking mechanism (not shown) that locks the sliding sleeve 303 in place to prevent subsequent movement of the sliding sleeve 303 once the inner string 311 is fluidly isolated from the wellbore 116. In one or more of such embodiments, the locking mechanism includes a collet that locks the sliding sleeve 303 in place to prevent movement of the sliding sleeve 303. In one or more of such embodiments, the collet has a shaped outer profile that fits into a similarly shaped groove that locks the sliding sleeve 303 of the float equipment assembly 221 to prevent movement of the sliding sleeve 303. In or more of such embodiments, the sliding sleeve 303 includes a protrusion that fits into a groove of the float equipment assembly 221, where the groove of the float equipment assembly 221 prevents movement of the sliding sleeve 303 once the protrusion slides into the groove. In one or more embodiments, pressure from fluids flowing in the inner string 311 prevents the sliding sleeve from moving.

Although FIGS. 3A and 3B illustrate a cross-sectional view of one spring 302 and one sliding sleeve 303, in some embodiments, the float equipment assembly 221 includes two or more springs and sliding sleeves (not shown) that are separately or collectively repositioned to isolate the inner string 311 and the annulus 194 from the wellbore 116. Further, in the embodiment of FIG. 3B, the sliding sleeve 303 is repositioned by the spring 302 after approximately 100% of the dissolvable material has dissolved. In some embodiments, the sliding sleeve 303 is repositioned after a different threshold portion (e.g., 10%, 30%, 50%, or another percent) of the dissolvable material is dissolved. Further, although FIGS. 3A and 3B illustrate two openings 308 and 309, the float equipment assembly 221 may include a different number of openings (not shown). Although FIG. 3A illustrates the spring 302 in a compressed state, in some embodiments, the spring 302 is configured in a tension state where force generated by tension of the spring 302 causes the sliding sleeve 303 to slide over the openings 308 and 309.

FIG. 4A illustrates a detailed cross-sectional view of a float equipment assembly 321 in accordance to another embodiment before a threshold portion of a dissolvable material 406 has dissolved. In the illustrated embodiment, the float equipment assembly 321 contains a ball 402 that is placed within an inner string 411. In the illustrated embodiment, the inner string 411 is fluidly coupled to a downhole string, such as to the annulus 194 of the completion string 150 of FIGS. 1A and 1B. Further, fluids flowing through the inner string 411 of the float equipment assembly 321 initially flow along a flow path illustrated by arrow 451A and exit the float equipment assembly 321 via opening 408 of the float equipment assembly 321, or along a second flow path illustrated by arrow 451B and exit the float equipment assembly 321 via opening 409 of the float equipment assembly 321. During completion of the well, the dissolvable material 406 prevents the ball 402 from sliding to the bottom of the inner string 411. However, after the dissolvable material 406 has partially or completely dissolved, the ball 402 slides to the bottom of the inner string 411 and covers the openings 408 and 409.

Figure 4B:
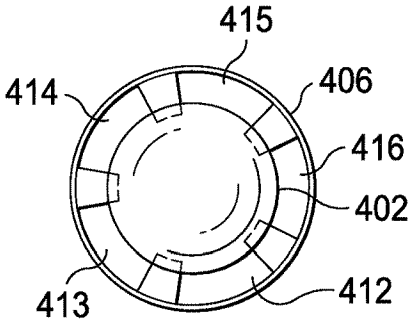
FIG. 4B illustrates a detailed top-down view of the dissolvable material of the float equipment assembly of FIG. 4A.
Figure 4A:
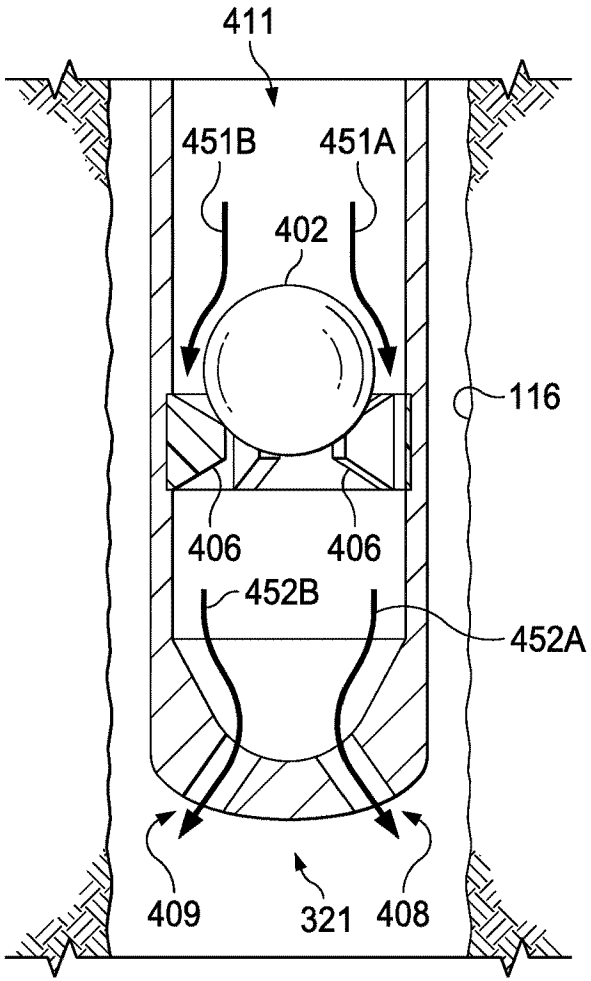
FIG. 4A illustrates a detailed cross-sectional view of a float equipment assembly in accordance to another embodiment before a threshold portion of a dissolvable material has dissolved.
Figure 5C:
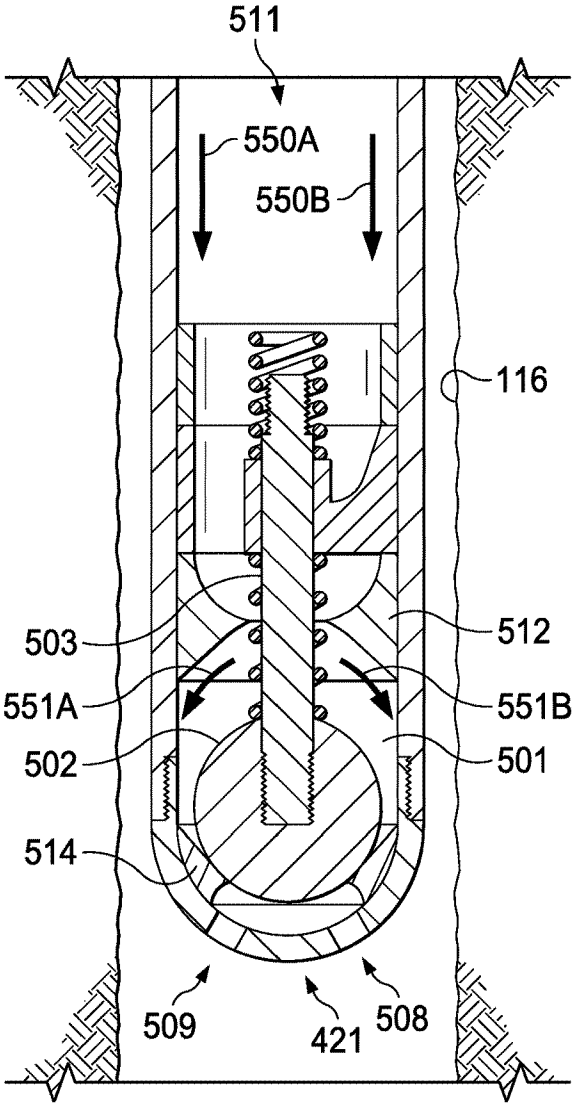
FIG. 5C illustrates a detailed cross-sectional view of a float equipment assembly of FIG. 5A after the threshold portion of the dissolvable material has dissolved.
Figure 5B:
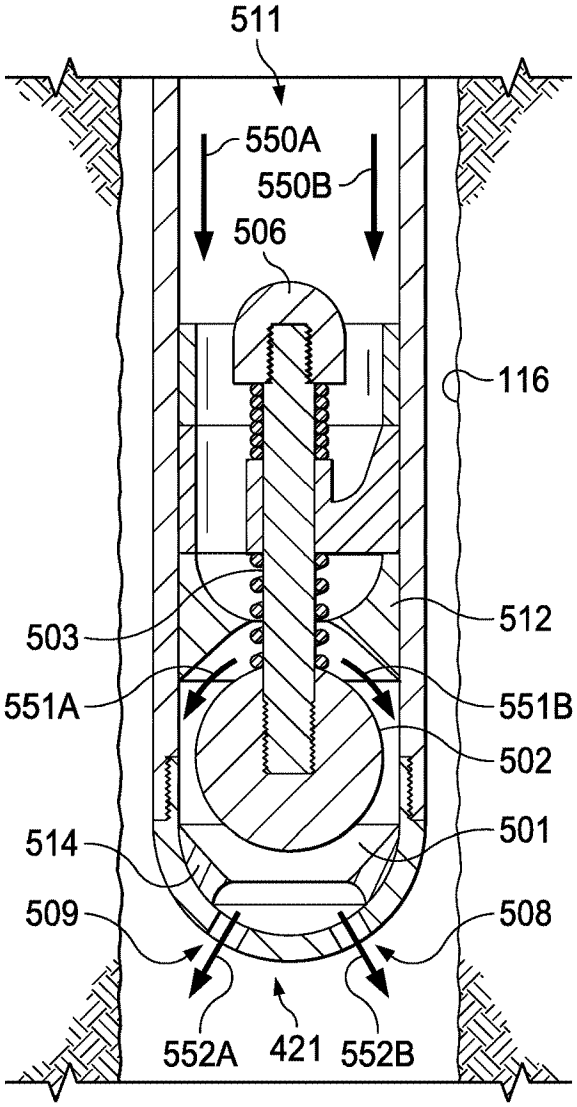
FIG. 5B illustrates a detailed cross-sectional view of a float equipment assembly of FIG. 5A after deployment of the float equipment assembly but before a dissolvable material has dissolved.
Figure 5A:
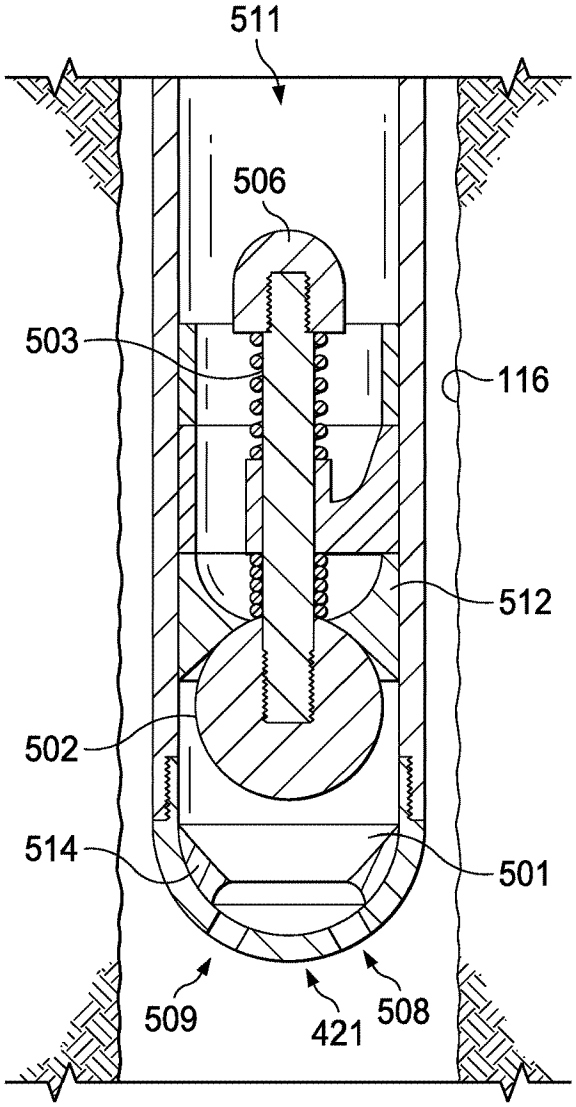
FIG. 5A illustrates a detailed cross-sectional view of a float equipment assembly in accordance to another embodiment before deployment of the float equipment assembly.

FIG. 4B illustrates a detailed top-down view of the dissolvable material 406 of the float equipment assembly 321 of FIG. 4A. In the illustrated embodiment, although the dissolvable material 406 prevents the ball 402 from sliding past the dissolvable material 406, the dissolvable material 406 contains fluid channels 412-416 that allow fluids flowing in the inner string 411 to flow through the dissolvable material 406 and exit the float equipment assembly 321 via the openings 408 and 409 of FIG. 4A.

FIG. 4C illustrates a detailed cross-sectional view of the float equipment assembly 321 of FIG. 4A after the threshold portion of the dissolvable material 406 of FIG. 4A has dissolved. In some embodiments, fluids flowing through the inner string 411 dissolve the dissolvable material 406 after the fluids come in contact with the dissolvable material 406. In some embodiments, the dissolvable material 406 dissolves over time and is partially or completely dissolved after the wellbore completion process. In some embodiments, a fluid or substance containing properties that dissolve the dissolvable material 406 comes into contact with the dissolvable material 406 after the wellbore completion process. After the dissolvable material 406 has partially or completely dissolved, the ball 402 slides down to the bottom of the inner string 411 and covers the openings 408 and 409, thereby fluidly isolating the inner string 411 from the wellbore 116. In one or more embodiments, fluids flowing in the inner string 411 exert a force on the ball 402 to prevent movement of the ball 402 once the openings 408 and 409 are covered by the ball 402. Although FIGS. 4A and 4C illustrate a cross-sectional view of one ball 402, in some embodiments, the float equipment assembly 321 includes two or more balls (not shown) that are separately or collectively repositioned to isolate the inner string 411 and the annulus 194 from the wellbore 116. Further, in the embodiment of FIG. 4C, the ball 402 slides to the bottom of the inner string 411 after approximately 100% of the dissolvable material 406 of FIG. 4A has dissolved. In some embodiments, the ball 402 slides to the bottom of the inner string 411 after a different threshold portion (e.g., 10%, 30%, 50%, or another percent) of the dissolvable material has dissolved. Further, although FIGS. 4A and 4C illustrate two openings 408 and 409, the float equipment assembly 321 may include a different number of openings (not shown).

FIG. 5A illustrates a detailed cross-sectional view of a float equipment assembly 421 in accordance to another embodiment before deployment of the float equipment assembly 421. In the illustrated embodiment, the float equipment assembly 421 contains a ball 502 deposited in a chamber 501, a dissolvable material 506 (e.g., a dissolvable retainer), and an extension piece 503 that is coupled to the dissolvable material 506 and the ball 502. Examples of an extension piece include but are not limited to, a bar, a rod, a pole, a shank, etc. In some embodiments, the extension piece 503 includes or is part of a spring mechanism that when actuated, drives the ball 502 into the chamber 501. In the illustrated embodiment, the chamber 501 has a first moveable member seat 512, a second moveable member seat 514, and openings 508 and 509 that allow fluids in the chamber 501 to flow into the wellbore 116. In the illustrated embodiment, the dissolvable material 506 and extension piece 503 initially hold the ball 502 against the first moveable member seat 512 of the float equipment assembly 421 to fluidly-seal the chamber 501 from inner string 511.

FIG. 5B illustrates a detailed cross-sectional view of a float equipment assembly 421 of FIG. 5A after deployment of the float equipment assembly 421 but before the dissolvable material 506 has dissolved. In the illustrated embodiment, the inner string 511 is fluidly coupled to a downhole string, such as to the annulus 194 of the completion string 150 of FIGS. 1A and 1B. In the illustrated embodiment, fluids flowing through the inner string 511 (such as in directions illustrated by arrows 550A and 550B) exert a force on the ball 502, thereby elongating the extension piece 503. As shown in FIG. 5B, the elongated extension piece 503 extends the ball 502 into the chamber 501 and in between the first moveable member seat 512 and the second moveable member seat 514, thereby breaking the initial fluid seal illustrated in FIG. 5A. In the illustrated embodiment, fluids flowing through the inner string 511 of the float equipment assembly 421 flow along a flow path illustrated by arrows 550A and 551A, and through opening 509 in a direction illustrated by arrow 552A to exit the float equipment assembly 421, or along a second flow path illustrated by arrows 550B and 551B, and through opening 508 in a direction illustrated by arrow 552B to exit the float equipment assembly 421. During completion of the well, the dissolvable material 506 prevents further elongation of the extension piece 503. However, after the dissolvable material 506 has partially or completely dissolved, the extension piece 503 further extends into the chamber 501 until the ball 502 rests on the second moveable member seat 514.

FIG. 5C illustrates a detailed cross-sectional view of the float equipment assembly 421 of FIG. 5A after the threshold portion of the dissolvable material 506 of FIG. 5A has dissolved. In some embodiments, fluids flowing through a downhole string, such as to the annulus 194 of the completion string 150 of FIGS. 1A and 1B, dissolve the dissolvable material 506 after the fluids come in contact with the dissolvable material 506. In some embodiments, the dissolvable material 506 dissolves over time and is partially or completely dissolved after the wellbore completion process. In some embodiments, a fluid or substance containing properties that dissolve the dissolvable material comes into contact with the dissolvable material 506 after the wellbore completion process. After the threshold portion of the dissolvable material 506 has dissolved, fluids flowing into the float equipment assembly 421, such as in directions illustrated by arrows 550A and 551A, or 550B and 551B, continue to apply a force onto the ball 502. The force applied onto the ball 502 causes the extension piece 503 to further extend into the chamber 501 until the ball 502 rests on the second moveable member seat 514, thereby preventing fluids to flow through the openings 508 and 509, and isolating the float equipment assembly 421 from the wellbore 116.

In one or more embodiments, fluids flowing in the inner string 511 exert a force on the ball 502 to prevent movement of the ball 502 once the openings 508 and 509 are covered by the ball 502. In one or more embodiments, where the extension piece 503 includes or is a part of a spring mechanism (not show), the spring mechanism is actuated after dissolution of the threshold portion of the dissolvable material 506. In one or more of such embodiments, force generated by the spring mechanism drives the ball 502 into the second moveable member seat 514, thereby covering openings 508 and 509.

Although FIGS. 5A-5C illustrate a cross-sectional view of one ball 502, in some embodiments, the float equipment assembly 421 includes two or more balls (not shown) that are separately or collectively repositioned to isolate the inner string 511 and the annulus 194 from the wellbore 116. Further, in the embodiment of FIG. 5C, the ball 502 slides to the bottom of the float equipment assembly 421 after approximately 100% of the dissolvable material 506 of FIG. 5A has dissolved. In some embodiments, the ball 502 slides to the bottom of the inner string 511 after a different threshold portion (e.g., 10%, 30%, 50%, or another percent) of the dissolvable material 506 has dissolved. Further, although FIGS. 5A-5C illustrate two openings 508 and 509, the float equipment assembly 421 may include a different number of openings (not shown).

Figure 6:
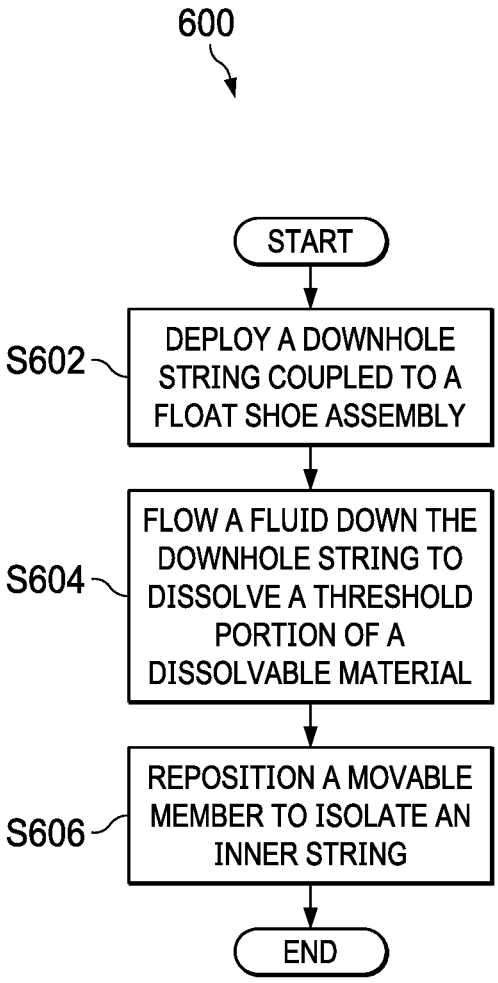
FIG. 6 is a flow chart of a process to isolate a downhole string.

FIG. 6 is a flow chart of a process to operate a float equipment assembly of FIGS. 2A-2B, FIG. 3A-3B, or 4A-4C to isolate a downhole string. Although the operations in the process 600 are shown in a particular sequence, certain operations may be performed in different sequences or at the same time where feasible.

At block S602, a downhole string (e.g., the completion string 150 of FIGS. 1A and 1B) that is coupled to a float equipment assembly (e.g., the float equipment assembly of. FIGS. 2A-2B, FIG. 3A-3B, 4A-4C or 5A-5C) is lowered downhole into a wellbore of a well. As described herein, the float equipment assembly includes an inner string that provides a fluid flow path from the downhole string and through the float equipment assembly. Further, the float equipment assembly also includes one or more openings that allow fluids flowing through the float equipment assembly to flow into the wellbore. The float equipment assembly further includes a moveable member which, when repositioned, isolates the inner string. The float equipment assembly further includes a dissolvable material that initially prevents movement of the moveable member. In the embodiments illustrated in FIGS. 2A and 2B, the moveable member is a piston that is stored in a chamber of the float equipment assembly and the dissolvable material is a dissolvable plug that initially seals the interior of the chamber. In the embodiments illustrated in FIGS. 3A and 3B, the moveable member includes a spring that is initially in a compressed state and a sliding sleeve. In such embodiments, the dissolvable material initially prevents the spring from reverting into an uncompressed state. In the embodiment of FIGS. 4A-4C, the moveable member is a ball deposited in the inner string and the dissolvable material initially prevents the ball from sliding to the bottom end of the inner string. In one or more of such embodiments, the dissolvable material includes one or more fingers that initially prevent the ball from sliding into the bottom end of the inner string. In one or more of such embodiments, the dissolvable material forms a cage around the ball to prevent the ball from sliding to the bottom end of the inner string. In the embodiment of FIGS. 5A-5C, the moveable member includes a ball positioned within a chamber of the float equipment assembly and an extension member that initially holds the ball against a moveable member seat to fluidly-seal the chamber from an inner string of the float equipment assembly.

At block S604, a fluid flows downhole through the downhole string to dissolve a portion of the dissolvable material. In some embodiments, the fluid flows through the downhole string while the downhole string is being deployed downhole. In some embodiments, the fluid flows through the downhole string after the downhole string is deployed at a desired location in the wellbore. In some embodiments, the fluid flows through the downhole string after completion of the wellbore. The fluid partially or completely dissolves the dissolvable material to reposition the moveable member.

At block S606, and after a threshold portion of the dissolvable material has dissolved, the moveable member of the float equipment assembly is repositioned to fluidly isolate the inner string of the float equipment assembly. In the embodiment illustrated in FIGS. 2A and 2B, where the dissolvable material is a dissolvable plug that initially seals the interior of the chamber, dissolving the dissolvable material allows fluids to flow into the chamber. In such embodiments, hydrostatic pressure caused by fluids flowing into the chamber actuates the piston and repositions the piston over the openings of the float equipment assembly to fluidly-seal the inner string from the wellbore. In the embodiments illustrated in FIGS. 3A and 3B, where the dissolvable material initially prevents the compressed string from reverting into an uncompressed state, the spring reverts to an uncompressed state after a threshold portion of the dissolvable material has dissolved. In such embodiments, force generated by the spring repositions the sliding sleeve and moves the sliding sleeve over the openings of the float equipment assembly to fluidly-seal the inner string from the wellbore. In some embodiments, the float equipment assembly includes a locking mechanism that locks the sliding sleeve in place after the inner string of the float equipment assembly is isolated from the wellbore. In the embodiments illustrated in FIGS. 4A-4C, where the dissolvable material initially prevents the ball from dropping to the bottom of the inner string, dissolution of the threshold portion of the dissolvable material allows the ball to drop to the bottom of the inner string to fluidly-seal the inner string from the wellbore. In the embodiments illustrated in FIGS. 5B-5C, where the dissolvable material initially prevents further elongation of the extension piece, dissolution of the threshold portion of the dissolvable material causes elongation of the extension piece until the ball is dropped to the bottom of the chamber, thereby fluidly isolating the inner string from the wellbore.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowchart depicts a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure:

Clause 1, a float equipment assembly, comprising: an inner string that provides a fluid flow path through the float equipment assembly; an opening through which a fluid flowing through the inner string exits the float equipment assembly; a moveable member which, when repositioned, isolates the inner string; and a dissolvable material that initially prevents repositioning of the moveable member, wherein the moveable member is repositioned after a threshold portion of the dissolvable material has dissolved.

Clause 2, the float equipment assembly of clause 1, wherein the moveable member comprises a piston which, when repositioned, closes the opening.

Clause 3, the float equipment assembly of clause 2, wherein the piston is stored in a chamber of the float equipment assembly, and wherein the dissolvable material is a dissolvable plug that initially seals the chamber.

Clause 4, the float equipment assembly of clause 3, wherein after the threshold portion of the dissolvable plug has dissolved, a hydrostatic pressure is applied to the piston to reposition the piston.

Clause 5, the float equipment assembly of any of clauses 1-4, wherein the moveable member comprises: a spring that is initially in a compressed state before the threshold portion of the dissolvable material has dissolved; and a sliding sleeve operable to slide over the opening.

Clause 6, the float equipment assembly of clause 5, wherein the dissolvable material holds the spring in the compressed state before the threshold portion of the dissolvable material has dissolved, wherein after the threshold portion of the dissolvable material has dissolved, the spring reverts to an uncompressed state, and wherein a force generated by the spring reverting to the uncompressed state slides the sliding sleeve over the opening.

Clause 7, the float equipment assembly of clause 6, wherein the sliding sleeve comprises a locking mechanism that prevents movement of the sliding sleeve after the sliding sleeve covers the opening.

Clause 8, the float equipment assembly of clause 7, wherein the locking mechanism is a collet located on the sliding sleeve with a shaped outer profile that fits into a similarly shaped groove locking that locks the sliding sleeve of the float equipment assembly to prevent movement of the sliding sleeve.

Clause 9, the float equipment assembly of any of clauses 1-8, wherein the moveable member comprises a ball deposited in the inner string.

Clause 10, the float equipment assembly of clause 9, wherein the opening is positioned proximate a bottom end of the float equipment assembly, and wherein the threshold portion of the dissolvable material comprises one or more fingers that prevents the ball from sliding to the bottom end of the float equipment assembly.

Clause 11, the float equipment assembly of clauses 9 or 10, wherein before the threshold portion of the dissolvable material has dissolved, the dissolvable material has one or more fluid channels around the ball.

Clause 12, the float equipment assembly of any of clauses 9-11, wherein the opening is positioned proximate a bottom end of the float equipment assembly, and wherein the threshold portion of the dissolvable material forms a cage that prevents the ball from sliding to the bottom end of the float equipment assembly.

Clause 13, a method to isolate a downhole string, the method comprising: deploying a downhole string coupled to a float equipment assembly, the float equipment assembly comprising: an inner string that provides a fluid flow path from the downhole string through the float equipment assembly; an opening through which a fluid flowing through the inner string exits the float equipment assembly; a moveable member which, when repositioned, isolates the inner string; and a dissolvable material that initially prevents repositioning of the moveable member; flowing a fluid down the downhole string to dissolve a threshold portion of the dissolvable material; and after the threshold portion of the dissolvable material has dissolved, repositioning the moveable member to isolate the inner string.

Clause 14, the method of clause 13, wherein the moveable member comprises a piston that is stored in a chamber of the float equipment assembly, wherein the dissolvable material is a dissolvable plug, and wherein repositioning the moveable member comprises applying a hydrostatic pressure to the piston after the threshold portion of dissolvable material has dissolved.

Clause 15, the method of clauses 13 or 14, wherein the moveable member comprises a spring that is initially in a compressed state before the threshold portion of the dissolvable material has dissolved and a sliding sleeve operable to slide over the opening, and wherein repositioning the moveable member comprises applying a force generated by the spring reverting to an uncompressed state to the sliding sleeve to slide the sliding sleeve over the opening.

Clause 16, the method of clause 15, further comprising, after sliding the sliding sleeve over the opening, locking the sliding sleeve in place.

Clause 17, the method of any of clauses 13-16, wherein the moveable member comprises a ball deposited in the inner string, wherein the opening is positioned proximate a bottom end of the float equipment assembly, and wherein repositioning the moveable member comprises flowing the ball to the bottom end of the float equipment assembly to isolate the inner string.

Clause 18, the method of clause 17, wherein the dissolvable material initially comprises one or more fingers that initially prevents the ball from sliding to the bottom end of the float equipment assembly, and wherein dissolving the threshold portion of the dissolvable material comprises dissolving the one or more fingers of the dissolvable material.

Clause 19, a downhole completion assembly comprising: a completion string; and a float equipment assembly coupled to the completion string, the float equipment assembly comprising: an inner string that provides a fluid flow path from the completion string through the float equipment assembly; an opening through which a fluid flowing through the inner string exits the float equipment assembly; a moveable member which, when repositioned, isolates the inner string; and a dissolvable material that initially prevents repositioning of the moveable member, wherein the moveable member is repositioned after a threshold portion of the dissolvable material has dissolved.

Clause 20, the downhole completion assembly of clause 19, wherein the moveable member comprises at least one of a piston, a ball, and a spring and sliding sleeve assembly.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A float equipment assembly, comprising:

an inner string that provides a fluid flow path through the float equipment assembly;

a chamber having an opening through which a fluid flowing through the inner string flows through the chamber and exits the float equipment assembly via the opening;

a moveable member which, when repositioned, isolates the inner string; and a dissolvable material that initially prevents repositioning of the moveable member, wherein the moveable member is at least partially repositioned within the chamber after a threshold portion of the dissolvable material has dissolved, and wherein the moveable member comprises of a piston.

2. The float equipment assembly of claim 1, wherein the moveable member comprises a piston which, when repositioned, closes the opening.

3. The float equipment assembly of claim 2, wherein the piston is stored in a chamber of the float equipment assembly, and wherein the dissolvable material is a dissolvable plug that initially seals the chamber.

4. The float equipment assembly of claim 3, wherein after the threshold portion of the dissolvable plug has dissolved, a hydrostatic pressure is applied to the piston to reposition the piston.

5. A method to isolate a downhole string, the method comprising:

deploying a downhole string coupled to a float equipment assembly, the float equipment assembly comprising:

an inner string that provides a fluid flow path from the downhole string through the float equipment assembly;

a chamber having an opening through which a fluid flowing through the inner string flows through the chamber and exits the float equipment assembly via the opening;

a moveable member which, when repositioned, isolates the inner string; and a dissolvable material that initially prevents repositioning of the moveable member;

flowing a fluid down the downhole string to dissolve a threshold portion of the dissolvable material; and after the threshold portion of the dissolvable material has dissolved, partially repositioning the moveable member into the chamber to isolate the inner string, and wherein the moveable member comprises a piston.

6. The method of claim 5, wherein the moveable member comprises a piston that is stored in a chamber of the float equipment assembly, wherein the dissolvable material is a dissolvable plug, and wherein repositioning the moveable member comprises applying a hydrostatic pressure to the piston after the threshold portion of dissolvable material has dissolved.

7. A downhole completion assembly comprising:

a completion string; and a float equipment assembly coupled to the completion string, the float equipment assembly comprising:

an inner string that provides a fluid flow path from the completion string through the float equipment assembly;

a chamber having an opening through which a fluid flowing through the inner string flows through the chamber and exits the float equipment assembly via the opening;

a moveable member which, when repositioned, isolates the inner string; and a dissolvable material that initially prevents repositioning of the moveable member, wherein the moveable member is repositioned after a threshold portion of the dissolvable material has dissolved, and wherein the moveable member comprises a piston.

* * * * *